United States Patent [19]

Wickers et al.

[11] Patent Number: 4,694,766

[45] Date of Patent: Sep. 22, 1987

[54] METHOD AND APPARATUS FOR REGISTERING AND CLAMPING LARGE WORKPIECES

[75] Inventors: Francis A. Wickers, Beverly; Max Raines, Salem, both of Mass.

[73] Assignee: USM Corp., Flemington, N.J.

[21] Appl. No.: 947,015

[22] Filed: Dec. 29, 1986

[51] Int. Cl.[4] ..... D05B 21/00

[52] U.S. Cl. ..... 112/262.1; 112/121.12; 112/121.15

[58] Field of Search ..... 112/121.15, 121.12, 112/121.11, 104, 114, 262.3, 262.1

[56] References Cited

U.S. PATENT DOCUMENTS

| | | | |
|---|---|---|---|
| 3,739,733 | 6/1973 | Schramayr | 112/121.12 |
| 3,988,993 | 11/1976 | Brophy | 112/121.12 |
| 4,171,672 | 10/1979 | Dorosz et al. | 112/121.12 |
| 4,510,876 | 4/1986 | Garley et al. | 112/262.1 |

*Primary Examiner*—H. Hampton Hunter

[57] ABSTRACT

Method and apparatus are disclosed for registering and clamping the vamp portion of a boot relative to a flat boot shaft. Each side of the vamp portion of the boot is substantially folded in order to achieve registration with the previously registered and clamped boot shaft. Clamping of each substantially folded side of the vamp occurs in such a manner as to not distort the fold. The folded vamp is otherwise securely clamped so as to permit an automatic join and sew operation with respect to the registered and clamped flat boot shaft.

12 Claims, 4 Drawing Figures

METHOD AND APPARATUS FOR REGISTERING AND CLAMPING LARGE WORKPIECES

FIELD OF THE INVENTION

This invention relates to methods and apparatus for holding workpieces that are to be sewn by an automatic sewing machine. In particular, this invention relates to method and apparatus for clamping a workpiece that has been substantially distorted so as to allow for automatic sewing.

BACKGROUND OF THE INVENTION

U.S. Pat. No. 4,510,876 issuing on Apr. 16, 1986 discloses method and apparatus for registering the vamp portion of a shoe relative to previously positioned shoe quarters. The shoe quarters are first registered and clamped within a pallet. The vamp is next positioned over the thus registered shoe quarters and the tongue portion of the vamp is clamped. The vamp is now slightly distorted so as to align certain of its edges relative to edge guides in the pallet leaf that is holding the shoe quarters down. The thus distorted and registered vamp is now further clamped by another leaf of the pallet that is rotated downwardly into position.

The above described method and apparatus for registering and clamping a distorted vamp is not particularly desirable for registering and clamping a large vamp such as is encountered with a cowboy boot. In this regard, the large cowboy boot vamp must be distorted or folded considerably more in order to accomplish a registration of the vamp edges with respect to other portions of the cowboy boot. In doing this, the large vamp would have such large folds that they could not be registered and clamped for automatic sewing according to the method and apparatus disclosed in U.S. Pat. 4,510,876.

OBJECT OF THE INVENTION

It is an object of the invention to provide method and apparatus for registering and clamping a substantially distorted workpiece member during its registration with respect to another workpiece member.

It is another object of the invention to provide method and apparatus for registering and clamping a large vamp for a cowboy boot relative to certain other upper portions of the cowboy boot.

SUMMARY OF THE INVENTION

The above and other objects of the invention are achieved by first registering a flat boot shaft on the base plate of a pallet. The thus registered boot shaft is clamped by a first rotatable leaf that is brought down over the boot shaft. The rotatable leaf includes a contoured edge that allows a large vamp to be centrally registered therewith over an exposed part of the boot shaft. A second leaf is now rotated downwardly over the thus centrally registered vamp. This second rotatable leaf is contoured in such a manner as to only engage the central portion of the vamp. A force bearing member is now activated so as to maintain the second rotatable leaf against the vamp. The thus registered and clamped vamp is now folded significantly so as to further align one side of the vamp relative to the boot shaft. Following this registration, a first clamp is activated so as to hold the thus folded one side of the vamp. The other side of the vamp is now folded so as to appropriately register this side of the vamp with the boot shaft and a second clamp is activated so as to hold this side of the vamp in position. In accordance with the invention, the thus registered and clamped vamp is exposed along the entire contour that is to be sewn to the boot shaft. This allows the vamp to be sewn to the boot shaft along one continuous stitch path.

BRIEF DESCRIPTION OF THE DRAWINGS

The above and other features of the invention will now be described with reference to the accompanying drawings in which.

DESCRIPTION OF THE PREFERRED EMBODIMENT

Figure 1:
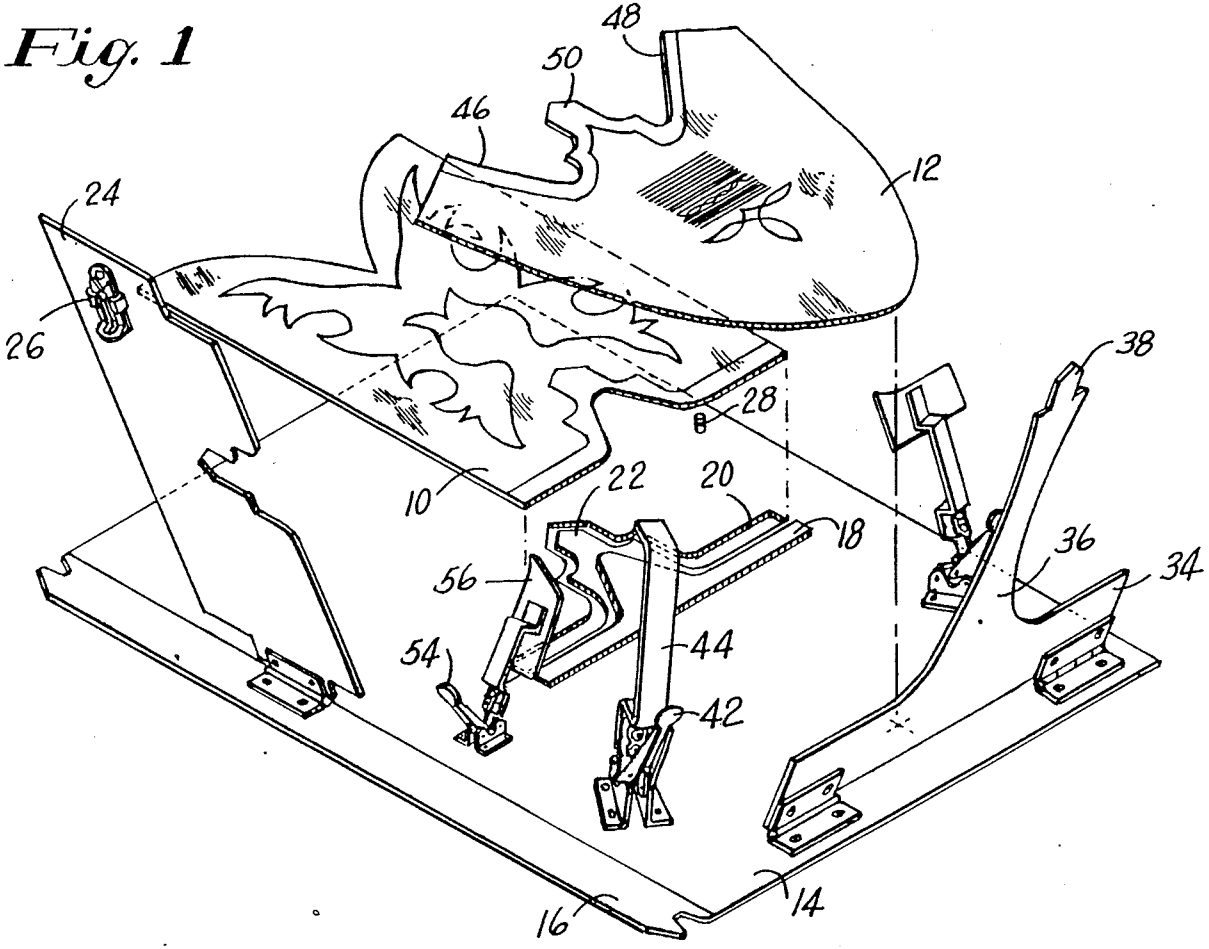
FIG. 1 illustrates the vamp and boot shaft of the cowboy boot relative to the apparatus for registering and clamping these separate pieces.

Referring to FIG. 1, the boot shaft 10 and vamp 12 of a boot are suspended above a pallet having a base plate 14. The boot shaft 10 and vamp 12 are to be registered and secured to the base plate 14 by various clamping devices. The pallet will thereafter be attached via the member 16 to the movable carriage of an automatic sewing machine. The thus attached pallet will be thereafter automatically positioned with respect to a high speed reciprocating sewing needle which will sew the two registered and clamped pieces together.

The boot shaft 10 is first registered with respect to a raised edge guide 18 on the base plate 14 in such a manner that its lower portion lies over a hole 20 in the base plate. The configuration of the hole 20 is such as to accommodate the reciprocating sewing needle when automatic sewing occurs. It is to be noted that the configuration of the hole 20 in the base plate also defines a base plate portion 22 lying below the hole 20 and above the edge guide 18. This base plate portion 22 will support the lower part of the boot shaft 10 during needle penetration through the hole 20.

Figure 2:
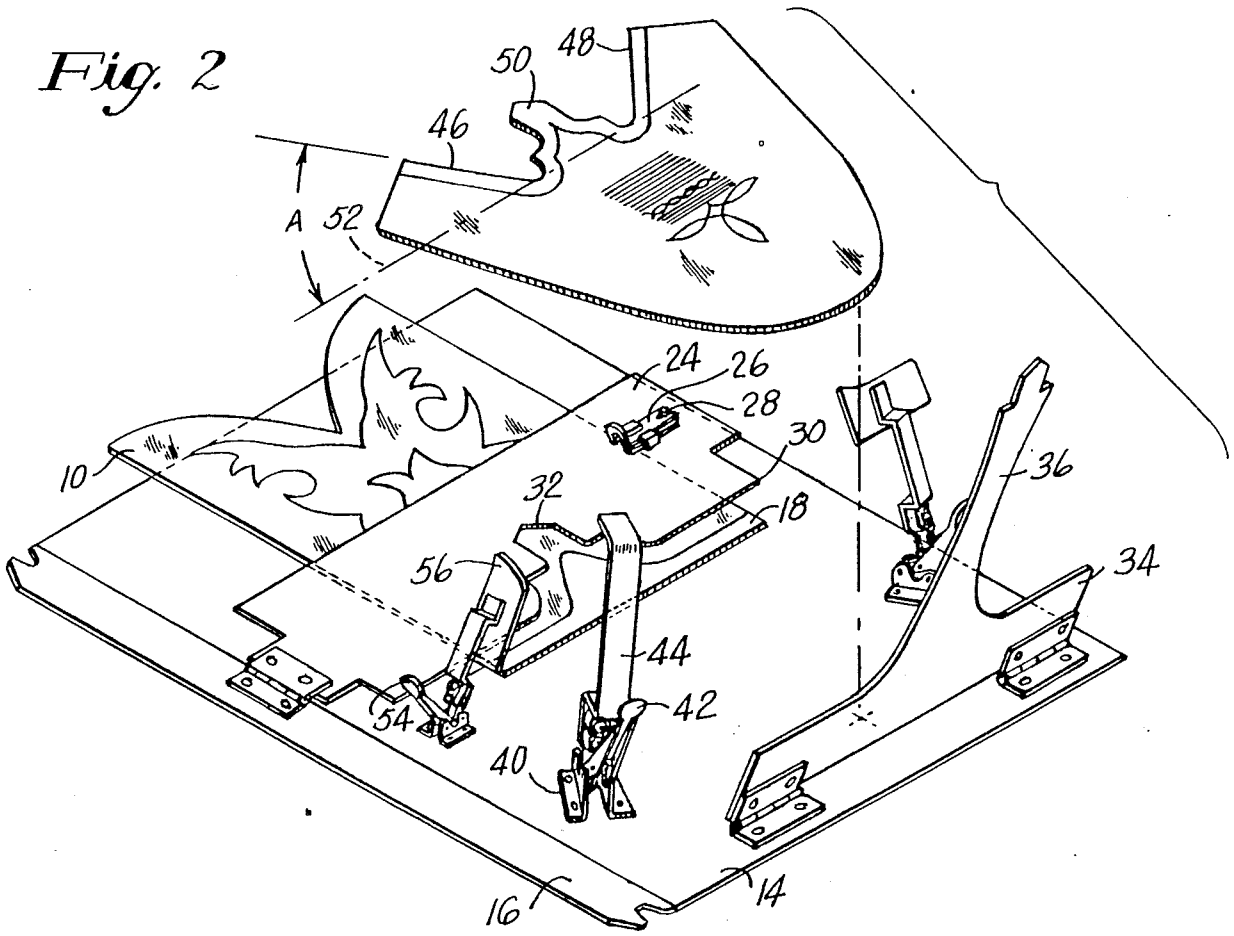
FIG. 2 illustrates the boot shaft of the cowboy boot having been registered and clamped within the apparatus.

A hinged pallet leaf 24 is next rotated downwardly into contact with the registered boot shaft 10 as is shown in FIG. 2. The hinged pallet leaf 24 is maintained in pressurized contact with the boot shaft 10 by a movable clip 26 on the pallet leaf engaging a pin 28 extending upwardly from the base plate 14. The hinged pallet leaf 24 is seen to include an edge 30 which is spaced from the lower edge of the boot shaft 10.

The vamp 12 is first centrally registered with respect to a central recessed contour 32 of the edge 30. A hinged pallet leaf 34 is now rotated downwardly into contact with the centrally registered vamp 12. It is to be noted that the hinged pallet leaf 34 includes a long, narrow centrally located extension 36 that contacts the central region of the vamp 12 to within a short-spaced distance of the registered top edge of the vamp 12. This is clearly shown in FIG. 3 wherein the foremost part 38 of the centrally located extension 36 contacts the top central portion of the vamp lying within the central recessed contour 32 of the edge 30 of the hinged pallet leaf 24. It is also to be noted that the periphery of the foremost part 38 of the extension 36 is shaped so as to substantially conform to the shape of the top edge of the vamp 12. The spacing of this periphery from the top edge of the vamp defines the area of the vamp to be sewn to the underlying area of the boot shaft.

Figures 3, 4:
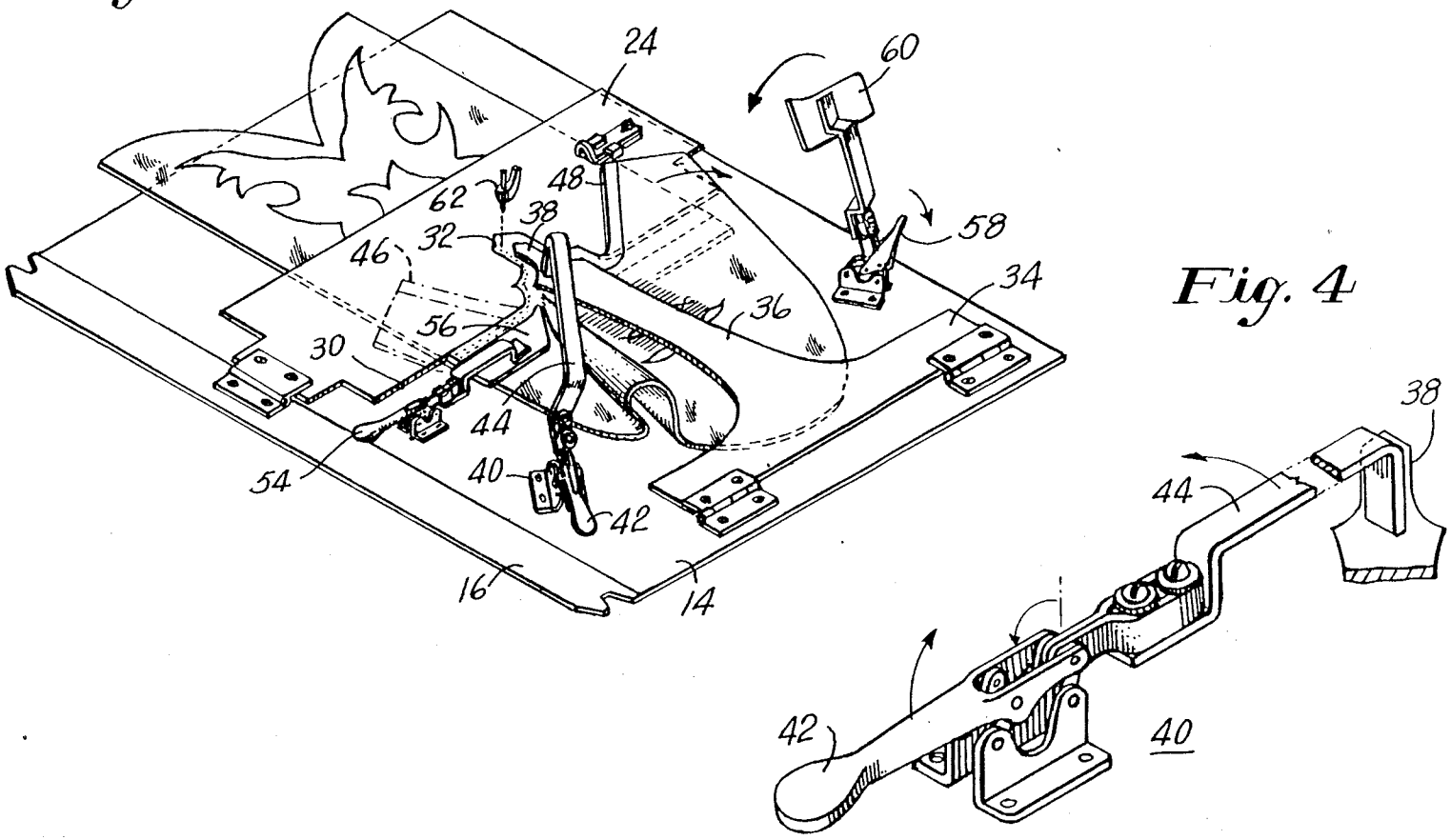
FIG. 3 illustrates the vamp of the boot having been registered, partially folded and clamped with respect to the boot shaft of the boot.
FIG. 4 illustrates a force application member within the apparatus of FIGS. 1 through 3.

The foremost part 38 of the extension 30 is maintained in pressurized contact with the top central portion of the vamp 12 by a thumb actuated clamp 40. Referring to FIG. 4, the thumb actuated clamp 40 is seen to comprise a thumb contact lever 42 which is pushed downwardly in order to pivot a long, stiff, force bearing member 44 downwardly into contact with the foremost part 38 of the extension 36. Referring to FIG. 1, it is to be noted that the support area 22 of the base plate will absorb the applied pressure from the force bearing member 44. In this manner, the top central area of the vamp 12 is adequately clamped for the ultimate automatic stitching operation.

The areas of the vamp 12 to either side of the central area must now be registered and clamped. Referring to FIG. 2, the top edges 46 and 48 to either side of the top central area 50 are seen to be at an angle "A" with respect to a horizontal line 52 passing through the lowest points in the curved top edge of the vamp. The angle "A" is in the range of sixty to seventy-five degrees for a typical cowboy boot. This angle range dictates that a considerable folding of each side of the vamp 12 must take place in order to register the respectie top edges with corresponding portions of the guide edge 30 of the hinged pallet leaf 24. In this regard, the corresponding portions of the guide edge 30 are substantially horizontal where registrations of the top edges 46 and 48 are to take place.

Referring to FIG. 3, the top edge 46 of the vamp 12 has been registered with the corresponding horizontal guide portion of the edge 30. The left side of the vamp 12 has been folded into a large loop so as to allow for this registration. A thumb actuated clamp 54 has moreover been pushed downwardly so as to cause a clamping member 56 to exert a local clamping pressure immediate to the fold in the vamp. It is to be noted that the edge of the clamping member 56 adjacent the fold is angled so as to follow the natural line of the fold. It is also to be noted that the top corner of the angled edge is spaced only a short distance from the outwardly extending periphery of the foremost part 38 of the extension 30 so as to thereby allow for only a small amount of fold in the vamp in this area. It is also to be noted that the contour of the top edge of the clamping member 56 follows the opposing contour of the guide edge 30 at a spaced distance therefrom. This equivalence in contour assures that the vamp 12 will be uniformly clamped at the appropriate spaced distance from the guide edge 30.

It is to be appreciated that the top edge 48 of the vamp is now registered with the appropriate corresponding portion of the guide edge 30 in much the same manner as has been previously described for the top edge 46. The resulting large fold in the right side of the vamp is not disturbed when a thumb actuated clamp 58 is pushed downwardly so as to cause a clamping member 60 to clamp and hold the vamp at a spaced distance from the guide edge 30.

The vamp 12 is now completely registered and clamped with respect to the previously registered and clamped boot shaft 10. These two boot portions can now be joined together by sewing one or more continuous rows of stitches. Each row of stitches preferably begins in the top left corner area of the vamp, extends parallel with the top edge of the vamp and ends at the top right corner area of the vamp. Each such row of stitches is formed in the exposed area between the guide edge 30 and the top periphery of the clamping members 56, 60 and the foremost part 38 of the extension 36. This is accomplished by successively positioning the exposed area relative to a reciprocating sewing needle 62.

It is to be appreciated from the above that both method and apparatus have been disclosed for registering and clamping large pieces of a boot that are to be sewn together. It is to be understood that this method and apparatus may also be changed or altered without departing from the scope of the invention. In this regard other large pieces that are to be registered, folded, and clamped may dictate changes in the periphery of the clamping members without departing from the scope of the invention.

We claim;

1. Apparatus for registering and clamping large pieces of work within a pallet that is to be attached to the movable carriage of an automatic sewing machine, said apparatus comprising:

means for registering and clamping a first flat piece of work within the pallet;

means for registering only the central portion of a second piece of work relative to the first flat piece of work;

means for registering one side of the second piece of work relative to the first piece of work after folding the one side of the second piece of work;

means for clamping the one folded side of the second piece of work adjacent to the fold;

means for registering the other side of the second piece of work relative to the first piece of work by folding the other side of the second piece of work; and means for clamping the other folded side of the second piece of work adjacent to the fold therein.

2. The apparatus of claim 1 further comprising:

a rotatable pallet leaf having a narrow centrally located extension which extends along only the central portion of the second piece of work to within a short distance of the top edge of the second piece of work; and means for applying clamping force to the centrally located extension of the pallet leaf near the top edge of the second piece of work.

3. The apparatus of claim 1 wherein said means for registering only the central portion of a second workpiece comprises:

a centrally located, recessed edge contour in said means for registering and clamping the first flat piece of work.

4. The apparatus of claim 3 further comprising:

a rotatable pallet leaf having a narrow centrally located extension which extends along only the central portion of the second piece of work into the recessed edge contour in said means for registering and clamping the first flat piece; and means for applying clamping force to the centrally located extension of the rotatable pallet leaf within the recessed edge contour in said means for registering and clamping the first flat piece of work.

5. The apparatus of claim 1 wherein each of said means for registering a side of the second piece of work comprises:

a substantially straight edge contour located along the edge of said means for clamping the first flat piece of work, the straight edge being at an angle within a range of sixty to seventy-five degrees with respect to the top edge of the second piece of work that is to be registered therewith whereby the side of the second piece of work to be registered must be folded substantially so as to allow registration of the second piece of work with the substantially straight edge.

6. The apparatus of claim 5 wherein each of said means for clamping a folded side of the second piece of work comprises:

a clamping element having a top edge contour which is substantially the same as the contour of the top edge of the second workpiece in the area being clamped and furthermore having an angled edge contour adjacent to the fold of the second workpiece which follows the line of the fold.

7. A method for registering and clamping large pieces of work within a flat pallet that is to be attached to the movable carriage of an automatic sewing machine, said method comprising the steps of:

registering and clamping a first flat piece of work within the pallet;

registering only the central portion of a second piece of work relative to the registered and clamped first flat piece of work;

folding one side of the second piece of work so as to thereby register the folded side relative to the first piece of work;

clamping the one folded side of the second piece of work adjacent the fold;

folding the other side of the second piece of work so as to thereby register the other folded side relative to the first piece of work; and clamping the other folded side of the second piece of work adjacent the fold therein.

8. The method of claim 7 further comprising the step of:

clamping only the central portion of the second piece of work following the registration thereof with the first piece of work so as to permit the separate steps of folding and clamping each side of the second piece of work.

9. The method of claim 7 wherein each side of the second piece of work that is to be folded includes a top edge that is at an angle in the range of sixty to seventy-five degrees with respect to a bottom edge of the first piece of work wherein registration at a spaced distance therefrom is to take place and said steps of folding each side of the second piece of work comprises:

folding the side in a substantial loop so as to register the top edge of the folded side at a spaced distance from the respective bottom edge of the first piece of work.

10. The method of claim 9 further comprising the step of:

clamping only the central portion of the second piece of work following the registration thereof with the first piece of work so as to permit the folding and clamping of each side of the second piece of work into the substantial loops to either side of the clamped central portion.

11. The method of claim 10 wherein each step of clamping a folded side of the second piece of work comprises:

clamping the side of the second piece of work at a spaced distance from the clamped central portion of the second piece of work so as to allow the substantial folded loop to freely extend upwardly therebetween without any distortion of the folded loop.

12. The method of claim 9 wherein the first piece of work is the shaft portion of a boot and the second piece of work is the vamp portion of the boot.

* * * * *